United States Patent [19]

Zehr

[11] 4,121,632

[45] Oct. 24, 1978

[54] FIRE EXTINGUISHER CYLINDER FILLING STATION

[75] Inventor: William J. Zehr, Des Plaines, Ill.

[73] Assignee: The Protectoseal Company, Bensonville, Ill.

[21] Appl. No.: 836,132

[22] Filed: Sep. 23, 1977

[51] Int. Cl.[2] ..... B65B 1/32; B65B 31/00

[52] U.S. Cl. ..... 141/59; 141/83; 141/378

[58] Field of Search ..... 141/1 R, 7, 8, 59, 67, 141/83, 94, 231, 285, 286, 311 R, 369, 372, 378, 382, 375, 376; 248/410

[56] References Cited

U.S. PATENT DOCUMENTS

| | | | |
|---|---|---|---|
| 3,875,980 | 4/1975 | Getz | 141/311 R X |
| 3,942,561 | 3/1976 | Stoeffler | 141/378 X |
| 3,951,185 | 4/1976 | Bower et al. | 141/1 R |
| 4,053,001 | 10/1977 | Healey et al. | 141/83 X |

*Primary Examiner*—Richard E. Aegerter
*Assistant Examiner*—Frederick R. Schmidt
*Attorney, Agent, or Firm*—Wm. A. Snow

[57] ABSTRACT

A compact filling station for fire extinguisher cylinders wherein the cylinder is weighed as the fire extinguishing material is fed therein to determine the correct quantity in said cylinder and said cylinder is filled by using a vacuum.

5 Claims, 12 Drawing Figures

17
79
78
80
42
44
46
96
86
11
94
84
68
72
74
73
10
62
50
92
64
70
66
58
52
60
55
54
100
52''
53a
57
52'
63
51
17
56

FIRE EXTINGUISHER CYLINDER FILLING STATION

BACKGROUND OF THE INVENTION

The only known prior art are the patents to Getz, U.S. Pat. No. 3,875,980; Lieber, U.S. Pat. No. 1,149,844; King, U.S. Pat. No. 1,325,991; Fiant, U.S. Pat. No. 2,755,968; and Fluornoy, U.S. Pat. No. 3,078,685; no one of which is believed to disclose the present invention.

SUMMARY OF THE INVENTION

A device for filling fire extinguisher cylinders wherein a connection is made to the inlet of the cylinder and the air in the cylinder is evacuated simultaneously with the filling thereof by using the same vacuum pump and said cylinder and contents are simultaneously weighed to determine when the cylinder is full.

DETAILED DESCRIPTION OF THE DRAWINGS

Figures 1, 2, 3:
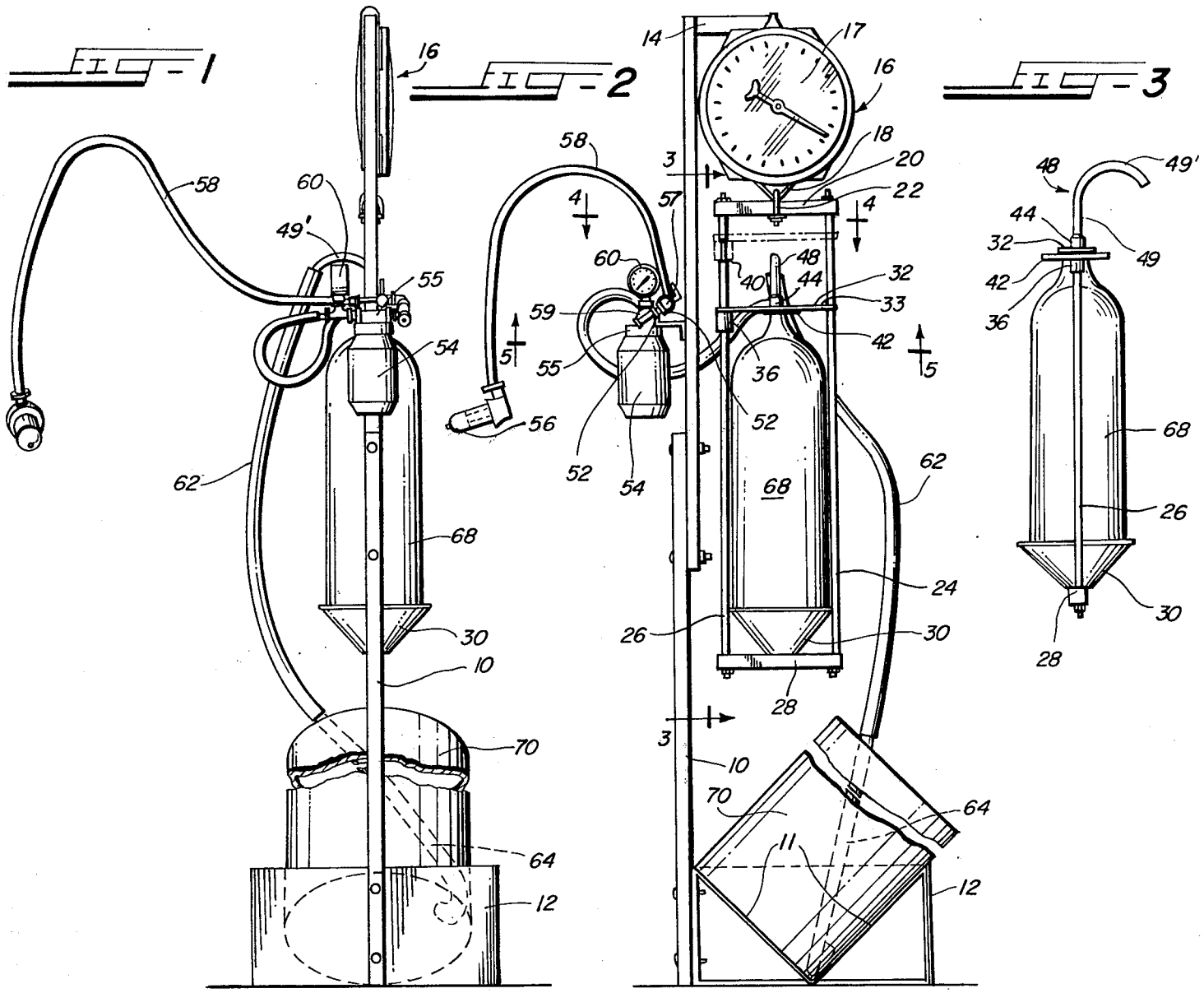
FIG. 1 is a side elevational view of the device of the present invention.
FIG. 2 is a front elevational view of the same.
FIG. 3 is a side elevational view taken on the lines 3—3 of FIG. 2.
Figure 4:
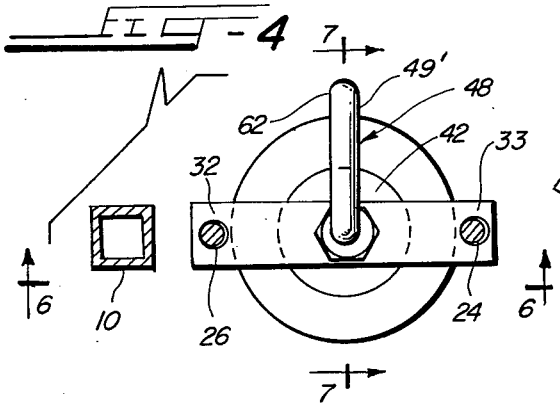
FIG. 4 is a top elevational view taken substantially on the lines 4—4 of FIG. 2.

The main embodiment of this invention comprises a vertical standard 10, preferably square in cross-section tubing, having a hollow integral base 12 and an arm 14 integrally secured at one end to the upper end of said standard 10. A calibrated weighing scale 16 hangs from and is secured to the free end of said arm 14. The bottom of said scale is provided with an integrally formed V-shaped hook or retaining means 18 to support a square in cross-section horizontal tube 20. The tube 20 is anchored to the retaining means by a U-bolt 22. A pair of vertically spaced tension bars 24, 26 depend from said tube 20, one on each end thereof.

A tube 28, square in cross-section, is secured to the bottom of the bars 24, 26 and extends therebetween. A hollow, inverted, conical-shaped seat 30 is secured to the upper surface of the tube 28 is which the lower end of a fire extinguishing cylinder is supported. The tubes 20, 28, tension bars 24, 26 and seat 30 form a cradle assembly.

A flat plate 32 extends between and laterally of the tension arms 24, 26 and is provided with an enlarged aperture 34, in one end 33, to be slidably engaged on the bar 24, while the opposite end of plate 32 is provided with a hollow, integrally formed, depending sleeve 36 slidably engaged on the bar 26.

Figure 7:
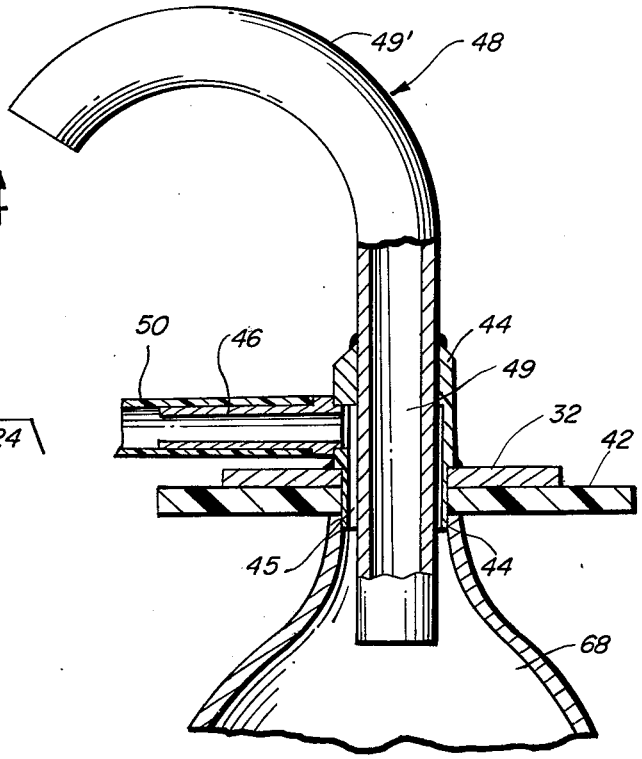
FIG. 7 is an enlarged cross-sectional view taken on the lines 7—7 of FIG. 4.
Figure 5:
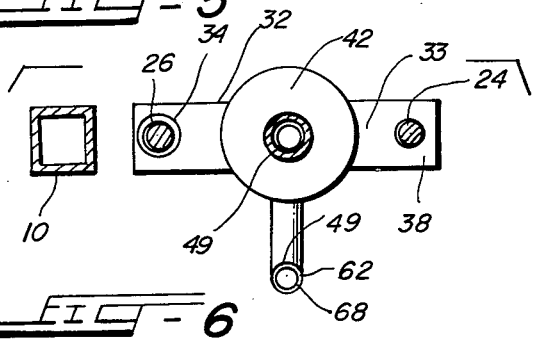
FIG. 5 is a cross-sectional view taken substantially on the lines 5—5 of FIG. 2.
Figure 6:
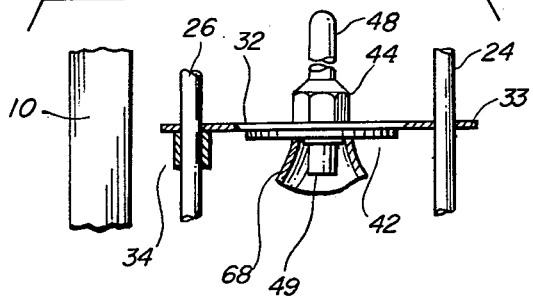
FIG. 6 is a cross-sectional view taken on the lines 6—6 of FIG. 4.

The bar 32 is provided with a circular rubber or sealing gasket 42 anchored to its bottom medially of the ends of the bar 32. A cylindrical, hollow, elongated connector 44 is anchored in vertical position to the bar 32 medially of its ends. The connector 44 provides a seat for the filler tube 48 which has a vertical portion 49 seating in and connected to the upper end of the connector and extending into the neck of the fire extinguishing cylinder 68. The upper end 49' is curved. A space 45 is provided between the outer walls of the portion 49 and the inner walls of the connector 44. See FIG. 7. A horizontally positioned vacuum tube nipple 46 is anchored to the side wall of connector 44 and has communication with space 45, as seen in FIG. 7.

A vacuum tube 50 is anchored at one end to nipple 46 and at the other end of the nipple 51 of the eductor type vacuum pump 52. The pump 52 (see FIG. 8) is secured to the cover 55 of the cannister 54 and the cover 55 is anchored to the standard 10 by a bracket. The cannister contains a powder trap assembly as shown at 63. A 50 to 125 psig air or inert gas inlet air line is connected to filter 56 and through tube 58 to the vacuum pump 52. The pump is provided with a valve 57 and a venturi opening 52" through which the air or inert gas passes to atmosphere. A vacuum gage 60 is also connected in the line.

A fill tube 62 is connected to the end of the curved portion 49' and at its lower end to an elongated pipe 64 which is provided with an L-fitting 66 at its free end.

In operation, an empty fire extinguisher cylinder 68 is positioned on the seat 30 vertically and the arm 32 moved downwardly from its parked position (shown in brokenlines in FIG. 2) whereby the lower end of connector 44 will be positioned in the interior of the cylinder 68, and the gasket 42 will lie against the mouth in the cylinder 68 to seal the same when a vacuum is created in the cylinder 68.

The pipe 64 is placed in a container 70 (shown in broken lines in FIGS. 1 and 2) filled with fire extinguishing chemical powder. The L-fitting 66 is placed against the bottom wall of the powder container 70. It is to be noted that the interior of the base 12 is provided with angular side walls 11 whereby the chemical container is positioned angularly therein as shown in FIG. 2.

The valve 57 is then opened and the air or inert gas will pass through filter 56, tube 58 and nipple 52' and out the venturi 52" thus creating in the cannister 54. This evacuates ambient air in the cylinder 68 via tube 50 and creates a vacuum in the cylinder to draw in air via tube 48, tubing 62, pipe 64 and elbow 66, which entrains powder, transporting it to the cylinder. If the cylinder is overfilled, the powder will be carried through opening 45 into nipple 46 and thence to the powder trap 54 which contains a filter element that permits air flow but bars passage of the powder.

The scale dial 17 is calibrated and when the cylinder 68 is filled, the scale dial will so indicate by weight and the valve 56 is manually closed and the bar 32 shifted to parked position. It is to be noted that the tension bar 26 is provided with a notch 40 adjacent its upper end to park the bar 32 thereon. This entire operation takes only a few minutes. The cylinder is then removed and another replaced and the process starts over again.

Figures 8, 9, 10:
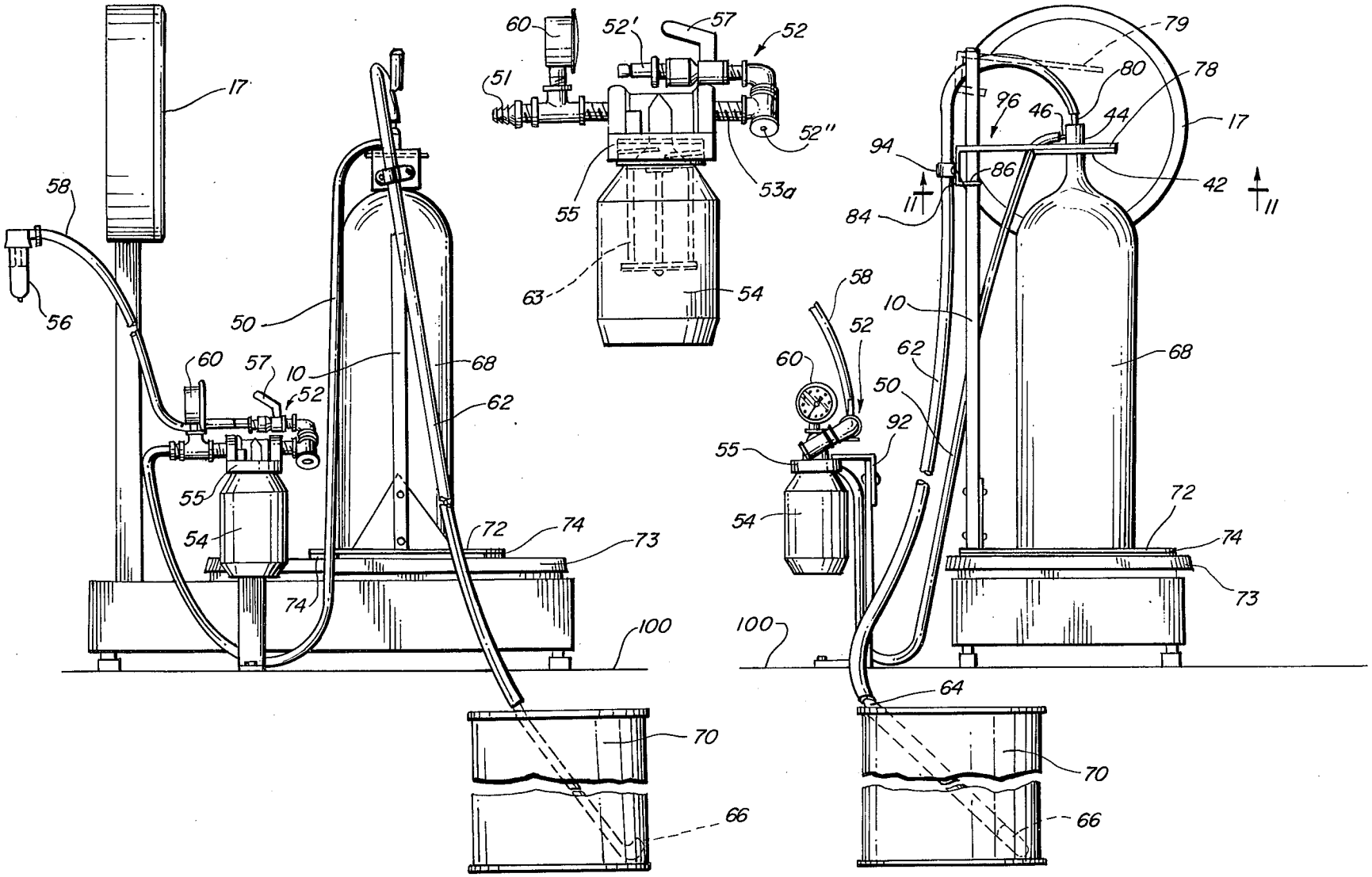
FIG. 8 is a side elevational view of the vacuum pump assembly.
FIG. 9 is a side elevational view of a modified form of construction.
FIG. 10 is a front elevational view thereof.

In the modification shown in FIGS. 9 and 10, the same standard 10 as in the preferred embodiment is employed, as well as the vacuum pump 52 and its attachments. In this modification, a platform scale is employed.The flat base 72 is secured to the lower part of the standard 10 at one side and is substantially square to seat on the platform of a platform weighing scale 73. Anti-skid members 74 are anchored to the lower face of the base 72 to prevent accidental shifting of base 72 on the scale platform 73.

Figure 12:
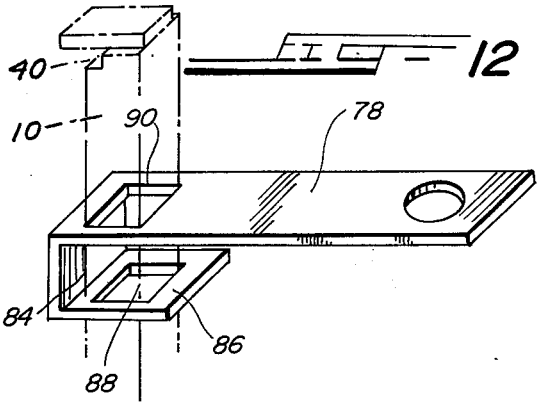
FIG. 12 is a perspective view of the locking device of the modified construction.
Figure 11:
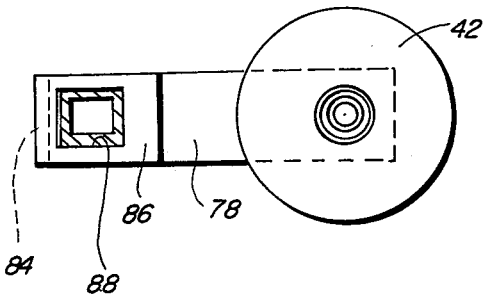
FIG. 11 is a bottom elevation taken on the lines 11—11 of FIG. 10.

The nipping lever 96 is provided on the standard 10 and comprises an elongated plate 78 perforated at one end as at 90 to be supported on standard 10. The arm 78 is bent downwardly at right angles as at 84 to the vertical and again at right angles to the horizontal as at 86 to form a short arm. (See FIG. 12.) The arm 86 is also provided with a perforation 88. The perforation at 90 is aligned with the perforation 88 in the arm 86, both perforations being slightly larger than the cross-sectioned area of the standard 10. The arms 78 and 86 are slidably positoned on the standard 10 via the perforations 88, 90 and the top of the cylinder will be sealed when a vacuum is created in the cylinder 68.

The vertically disposed nipple 80 is anchored in the hollow connector 44 which is anchored to the upper side of the nipping lever 76 and extends downwardly below the bar 78. A short horizontally disposed nipple 46 is anchored in the side of the connector as in the preferred embodiment. The vacuum pump and its tubings are identical with that of the preferred embodiment, as well as tube 62, pipe 64 and "L" fitting. The functions are the same as described in the preferred embodiment.

The cover 55 is secured adjacent the upper end of bracket 92 while the lower end is anchored to a bench 100, as shown.

A clip 94 is secured to the vertical member 84 to support the tube 62.

Although the container 70 in the modification is shown seated below the floor line or a bench in the drawings, it is to be understood it sits on the floor adjacent the scale.

The operation is the same as described in the preferred embodiment.

It is to be understood that numerous details of the construction shown may be altered or omitted without departing from the spirit of the invention as defined by the following claims.

I claim:

1. A fire extinguishing cylinder filling station comprising a vertical standard having a base, a cylinder support means to support an empty cylinder in a vertical position adjacent said standard, means on said support means to retain the cylinder thereon, a weighing scale, said supporting means depending from said scale, a source of fire extinguishing powder, conduit means connected between said source of powder and said cylinder, a vacuum pump for evacuating the interior of said empty cylinder and creating a vacuum therein, conduit means between said pump and said cylinder, said pump evacuating the air in said cylinder and creating a vacuum therein whereby to withdraw said powder from said source and fill said cylinder wherein the supporting means comprises a spaced pair of vertical elongated tension rods anchored together at the upper and lower ends by cross bars, and an inverted conical-shaped seat anchored to the lower bar to seat the lower end of the cylinder, and wherein the means to support said cylinder in vertical position comprises a flat bar perforated at its end to slidably shift on said rods, a connector bored axially on the bar medially its ends, a tube anchored to and extending above and below said bar, said bore being larger in diameter than the diameter of said tube whereby a hollow space is formed between the walls of said bore and the tube, nipple means on the exterior wall of said connector communicating with said hollow space, the lower end of said tube insertable in the cylinder, wherein said tube has fluid connection with said source of fire extinguishing powder to fill said cylinder and a conduit is connected to said vacuum pump and to said nipple means to create a vacuum in said cylinder to draw said powder from said source to fill said cylinder.

2. The device according to claim 1 wherein an arm extends at right angles from the upper end of said standard on which said weighing scale depends.

3. The device according to claim 2 wherein said vacuum pump is provided with a removable cannister, a powder trap in said cannister whereby all movement of vacuum from said pump passes through said trap.

4. The device of claim 1 wherein the the means for retaining the cylinder on the support means is a flat bar provided with a perforation on one end and a depending sleeve on the other end, said perforation and sleeve being slidable on said tension rods and therebetween, means on one of said tension rods for latching said bar when in nonuse.

5. The device according to claim 1 wherein said base has angular walls on which to seat the container having a source of fire extinguishing powder.

* * * * *